US006686004B2

(12) United States Patent
Daziano et al.

(10) Patent No.: US 6,686,004 B2
(45) Date of Patent: Feb. 3, 2004

(54) PACKAGING FOR PHOTOSENSITIVE DYES

(75) Inventors: Jean-Pierre Daziano, Marseilles (FR); André van Agthoven, Marseilles (FR)

(73) Assignee: Immunotech, Marseille Cedex (FR)

( * ) Notice: Subject to any disclaimer, the term of this patent is extended or adjusted under 35 U.S.C. 154(b) by 93 days.

(21) Appl. No.: 10/015,938

(22) Filed: Dec. 17, 2001

(65) Prior Publication Data

US 2002/0127356 A1 Sep. 12, 2002

(30) Foreign Application Priority Data

Dec. 15, 2000 (FR) ..... 00 16445

(51) Int. Cl.[7] ..... B32B 1/08; B01J 19/00

(52) U.S. Cl. ..... 428/34.7; 428/34.6; 428/36.91; 422/40; 422/41

(58) Field of Search ..... 428/35.7, 34.4, 428/34.5, 34.9, 36.9, 36.91, 36.92, 34.6, 34.7; 206/524.6; 422/40, 41, 61, 940

(56) References Cited

U.S. PATENT DOCUMENTS 5,110,643 A * 5/1992 Akao et al. ..... 428/35.9
5,750,226 A * 5/1998 Macauley et al. ..... 428/36.4
6,117,506 A 9/2000 Graboski et al.

FOREIGN PATENT DOCUMENTS

GB 2 086 342 A 5/1982
JP 405127526 A * 5/1993 ..... G03G/15/08

OTHER PUBLICATIONS

Abstract of Publication No. 05127526, Pub. May 25, 1993, "Toner Container".

* cited by examiner

*Primary Examiner*—Harold Pyon
*Assistant Examiner*—Michael C. Miggins
(74) *Attorney, Agent, or Firm*—Browdy and Neimark

(57) ABSTRACT

Packaging comprising a fluorochrome sensitive to visible light placed in a bottle of which at least the side walls form an effective screen against light spectrum radiation between 200 and 900 nm and a process for protecting fluorochromes sensitive to visible light during storage, in which said fluorochromes are placed in a bottle of which at least the side walls form an effective screen against light spectrum radiation between 200 and 900 nm.

5 Claims, 5 Drawing Sheets

PACKAGING FOR PHOTOSENSITIVE DYES

SUMMARY OF THE INVENTION

The present invention relates to new packaging for photosensitive dyes and a new method for the packaging of fluorochrome based reagents for cytometry.

Flow cytometry is a technique for analysing cells which has been much used for decades. This technique uses at least one fluorochrome.

It is a powerful tool in antigenic cell analysis. This technique makes it possible to analyse several antigenic targets at the same time thanks to combinations of antibodies conjugated to fluorochromes. The main fluorochromes used in cytometry are fluoroscein isothiocyanate (FITC), phycoerythrin (PE), allophycocyanine (APC), PercP, phycoerythrin-cyanine 5 (PC5), phycoerythrin-cyanine 7 (PC7) and phycoerythrin-texas red (ECD or PETR) tandems. These fluorochromes absorb light radiation particularly at 488 nm and 633 nm which are the main emission wavelengths of lasers used on cytometers. The PC5, PC7, ECD tandems use the energy transfer principle, that is to say that the laser of the cytometer excites the molecule in the spectral range of the phycoerythrin which returns the energy absorbed by the acceptor molecule (cyanine 5, cyanine 7 or Texas red) which will itself return it in radiative form at its emission wavelength.

The dye tandems nevertheless absorb the light over the whole spectral range and in particular in the visible range (400–800 nm) and the Applicant has realised that these fluorochromes, alone or in tandem, are subject to appreciable degradation during storage.

This degradation induces a deterioration in the efficiency of the energy transfer which leads to an increase in the fluorescence intensity of phycoerythrin at 580 nm. This phenomena is translated in cytometry by an increase in fluorescence (called loss) in the phycoerythrin canal (FL2) which can lead to different problems:

Appearance of false positive cells

A need to increase compensation in order to regain the intensity values of initial fluorescence.

The last point is particularly crucial in the case of computerised automatic compensation systems.

The phycoerythrin-allophycocyanine tandem was described nearly 20 years ago (Glazer et al. Biophys. J. (1983) 83, 383–386 and the phycoerythrin-cyanine 5 tandems nearly 10 years ago Lanier et al. Methods (1991) Vol 2 N°3 192–199. Ever since, this type of product has been marketed in brown or amber glass bottles by the BECTON DICKINSON, PHARMINGEN, DAKO, IQP, or CALTAG companies.

It would therefore be desirable to have available packaging for fluorochromes ensuring the storage of said fluorochromes over a prolonged period of time.

After a certain number of tests, the Applicant has put forward the hypothesis that these fluorochromes could be sensitive to visible light. The Applicant then covered the side walls of bottles containing fluorochromes with a heat-shrinkable sleeve absorbing visible light. A very appreciable improvement was then observed, which was not however, entirely satisfactory. The Applicant then commenced other tests which did not provide any additional progress.

Again continuing its research, the Applicant discovered with surprise that the fact that the bottom of the sleeved bottle is not protected is sufficient to degrade the fluorochromes when the bottles were handled or turned over flat on their side instead of being placed on their bottom. The Applicant then understood that these fluorochromes were very sensitive to wavelengths from 200 to 900 nanometers, in particular to visible light, particularly to wavelengths from 400 to 700 nanometers and singularly to wavelengths from 400 to 600 nanometers.

According to the Applicant, the origin of the degradation of the tandems is an induced photooxidation phenomenon in which the molecules play the role of photosensitizer, that is to say that they are capable of activating oxygen:

by transfer of the light energy absorbed with generation of singlet oxygen (so-called type II mechanism), by electron transfer to the excited state with generation of oxygenated radicals (so-called type I mechanism).

The invention relates to the use of bottles which are opaque to the tandem exciting light radiation, that is to say between 200 and 900 nm and more particularly between 400 and 800 nm.

That is why the present Application relates to a packaging comprising a fluorochrome sensitive to wavelengths from 200 to 900 nanometers and singularly to wavelengths from 400 to 600 nanometers and a bottle of which at least the side walls form an effective screen against the light spectrum radiation between 200 and 900 nm, in particular against wavelengths from 400 to 800 nanometers, more particularly 400 to 700 nanometers and singularly between 400 and 600 nm in which the said fluorochrome is placed.

In the present Application and in the following, the terms <<fluorochrome sensitive to visible light>> designates a fluorochrome the structure of which is degraded by an emission at the wavelengths indicated, for example fluoroscein isothiocyanate (FITC), phycoerythrin (PE), allophycocyanine (APC), PercP, phycoerythrin-cyanine 7 (PC7), phycoerythrin-cyanine 5 (PC5) and phycoerythrin-texas red (ECD or PETR) tandems, preferably the latter two. The terms <<forms an effective screen against radiation>> signifies that at least 95% of the visible light radiation, preferably at least 98%, in particular at least 99% and more particularly 100% is blocked by the side walls of the bottle because of its structure (nature, treatment, or sleeve for example). The term <<bottle>> preferably designates a small bottle preferably screw-topped, provided with a stopper with or without septum. The bottle can made of polyethylene, polypropylene, polycarbonate, but preferably glass. Its capacity being preferably from 50 $\mu$l to 50 ml, in particular 100 $\mu$l to 20 ml, particularly 500 $\mu$l to 10 ml and more particularly from 1 ml to 10 ml. A 5 ml bottle can for example be filled by 1 to 2 ml of solution.

Glass bottles of approximately 5 ml are quite particularly preferred.

Under preferred conditions for the implementation of the invention, the bottom of the bottle also forms an effective screen against visible spectrum radiation.

In perfumery techniques for covering or coating bottles forming an effective screen against visible spectrum radiation, used for aesthetic purposes are already known.

Coating by electrostatic powdering which consists of surrounding the bottles with a septum which is pierced by an electrode which is fitted into the bottle to be covered, can for example be mentioned. The bottles are placed in an enclosed space containing a pulverised powder and charged in an opposite manner to that of the bottle. The powder is then deposited on the bottle on which it is fixed, for example, by baking in an oven at approximately 180° C. Within the scope of the invention, an epoxy resin powder preferably absorbent in the wavelengths indicated above, particularly 600 to 800 nanometers, in particular black or blue in colour can for example be used.

The bottle can also be covered with an advantageously heat-shrinkable sleeve preferably also covering the bottom of the bottle.

Some types of glass can also be irradiated by gamma radiation.

Cast moulding using a plastic film can also be carried out, which offers the advantage of being able to cover the bottom of the bottles.

The packaging which the present invention relates to has very useful properties. The use of covered or treated bottles such as described above suppresses the phenomenon of photo-induced oxidation and gives the fluorochrome-antibody or tandem-antibody conjugates excellent stability.

These properties are illustrated hereafter in the experimental part.

The present invention also applies to antibody-tandem conjugates other than those mentioned above, as well as to all the fluorochromes used in flow cytometry.

The present Application also relates to a process of protecting fluorochromes sensitive to visible light and singularly at wavelengths from 400 to 600 nanometers during storage, in which said fluorochromes are placed in a bottle of which at least the side walls form an effective screen against the light spectrum radiation between 200 and 800 nm, particularly against wavelengths from 400 to 800 nanometers, more particularly of 400 to 700 nanometers and singularly between 400 and 600 nm.

The preferred conditions for implementation of the packaging described above also apply to the other subjects of the invention referred to above, in particular in the process of fluorochrome protection.

The following examples illustrate the present Application.

Figure 1A:
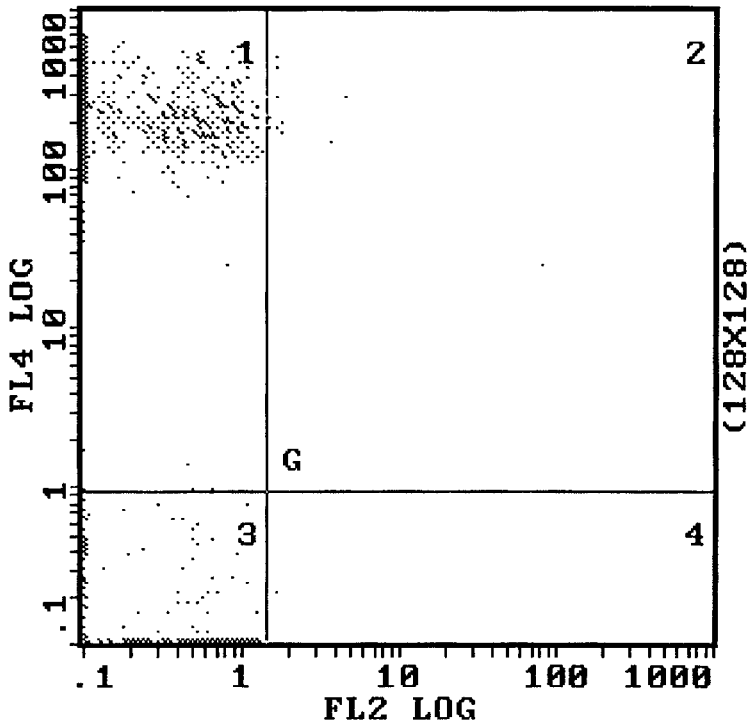
FIGS. 1A, B, C, D and E represent the fluorescence results obtained with samples of anti-CD3-Phycoerythrin-cyanine 5 antibody conjugates contained in their original bottle or a bottle according to the invention, and subjected to the action of the light, and FIGS. 2A, B, C and D represent the fluorescence results obtained with samples of anti-CD19-phycoerythrin-texas red antibody conjugates contained in their original bottle or a bottle according to the invention, and subjected to the action of light.
Figure 1B:
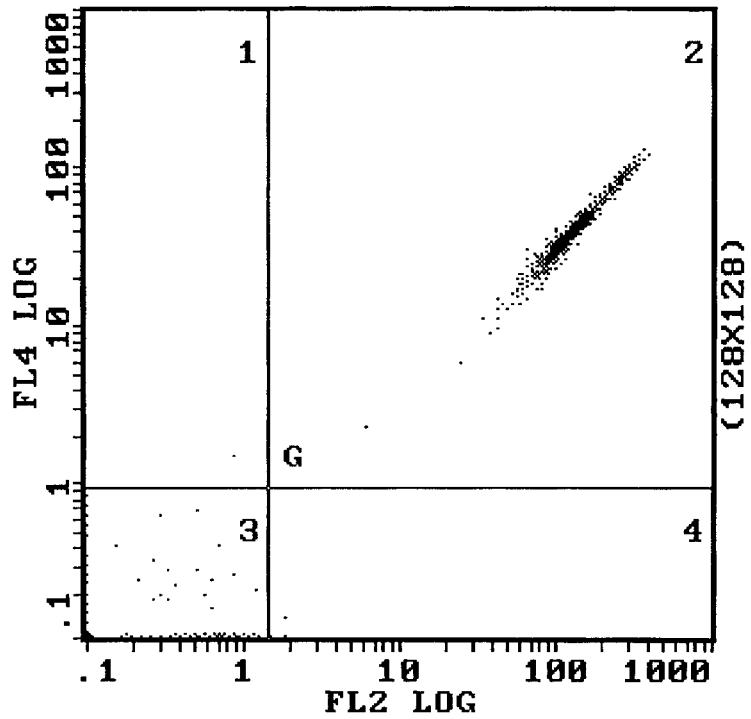
Figure 1C:
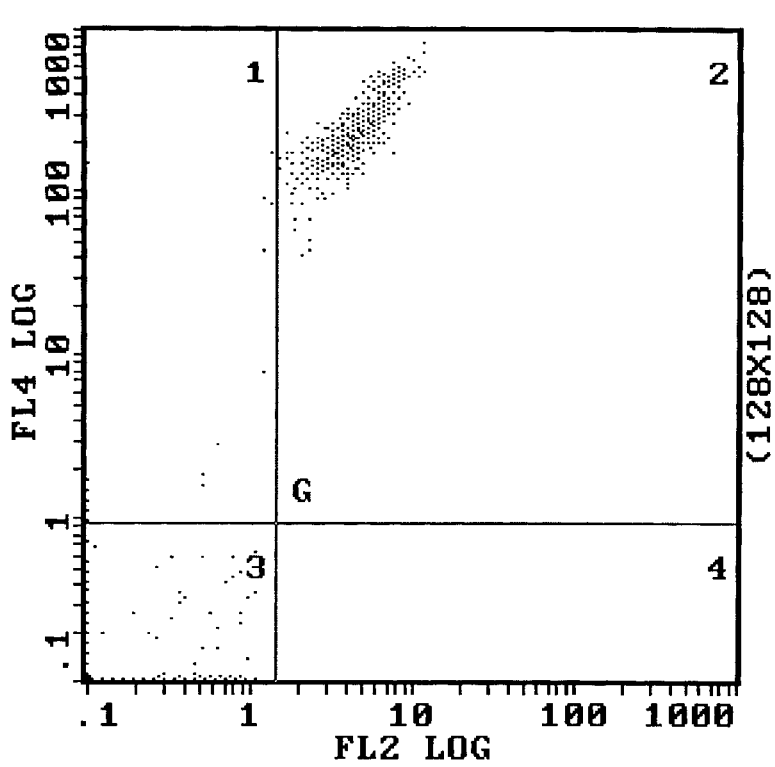
Figure 1D:
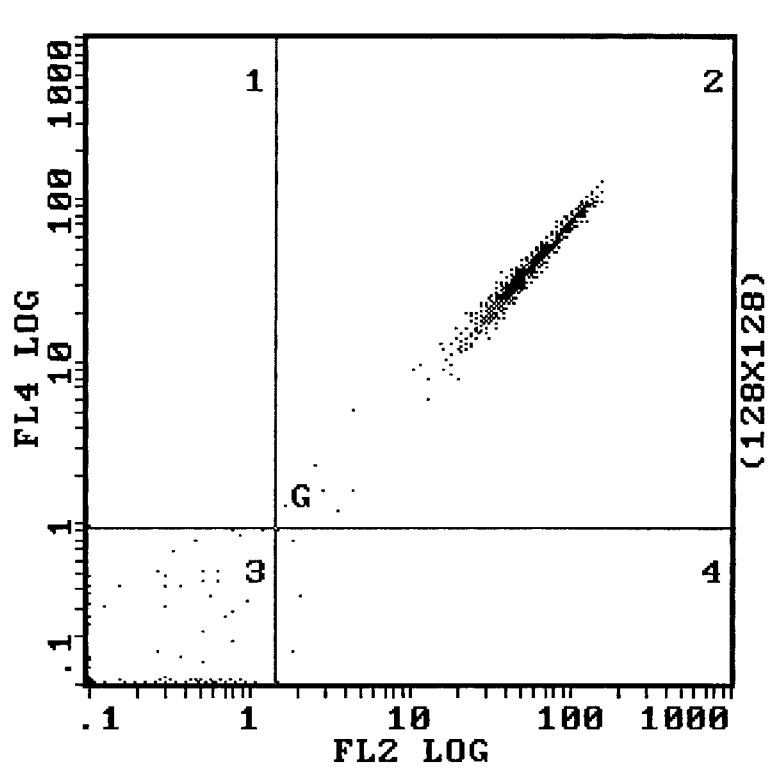
Figure 1E:
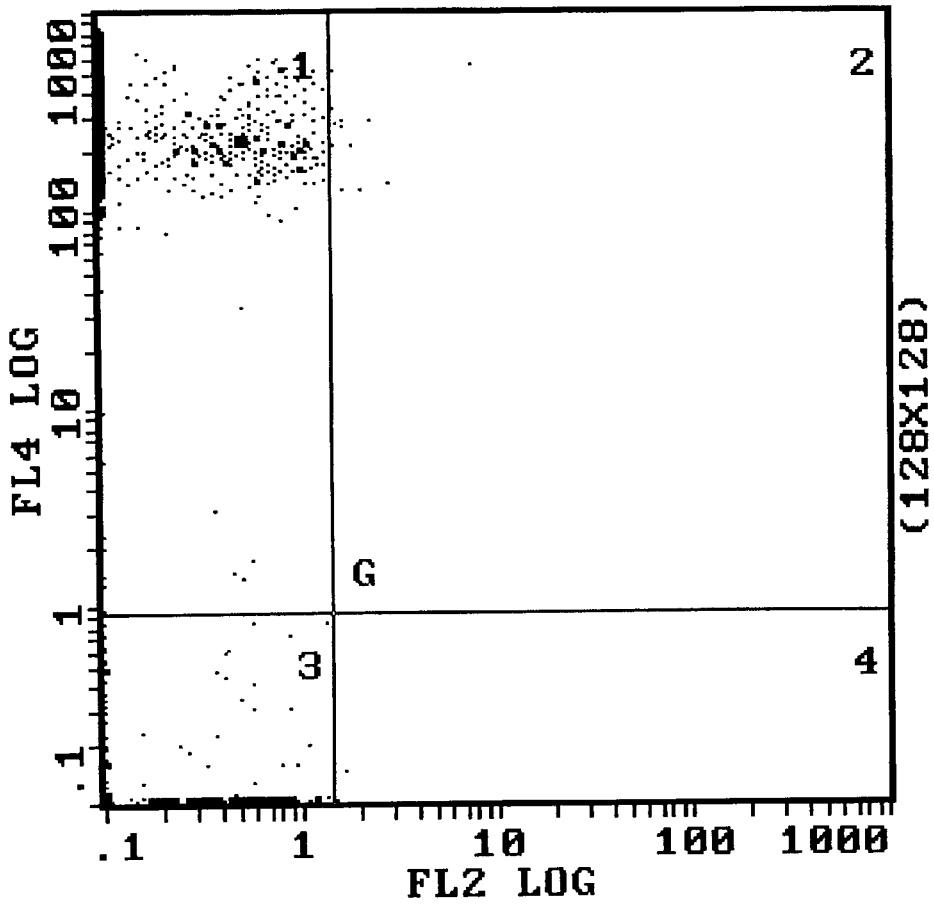
Figure 2A:
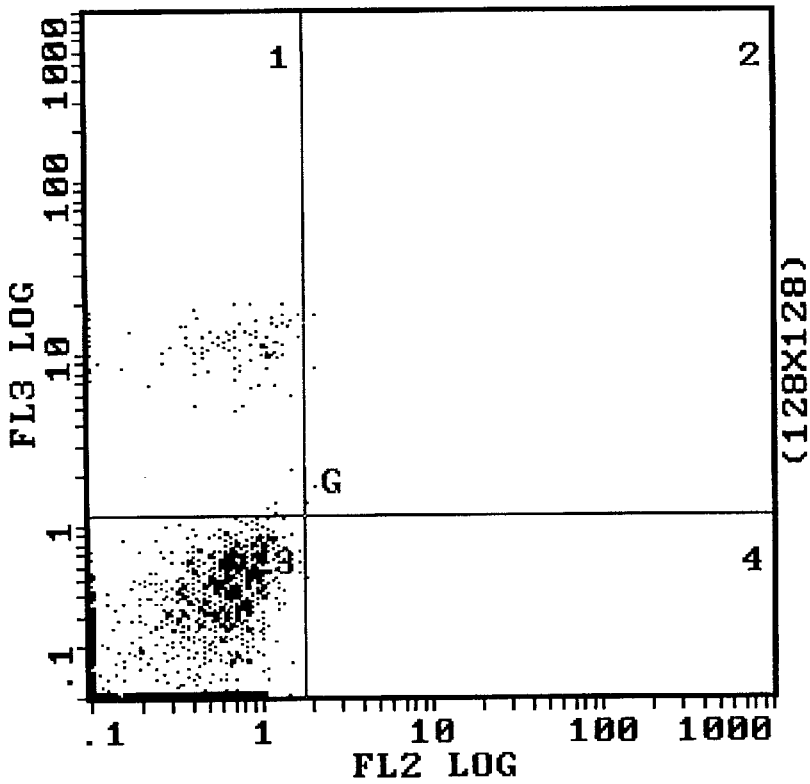
Figure 2B:
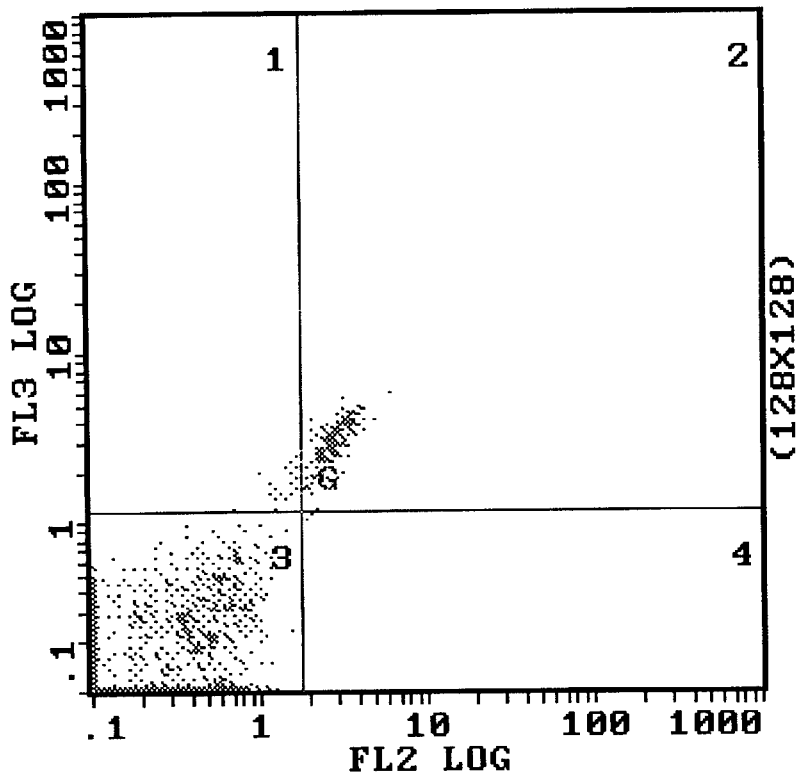
Figure 2C:
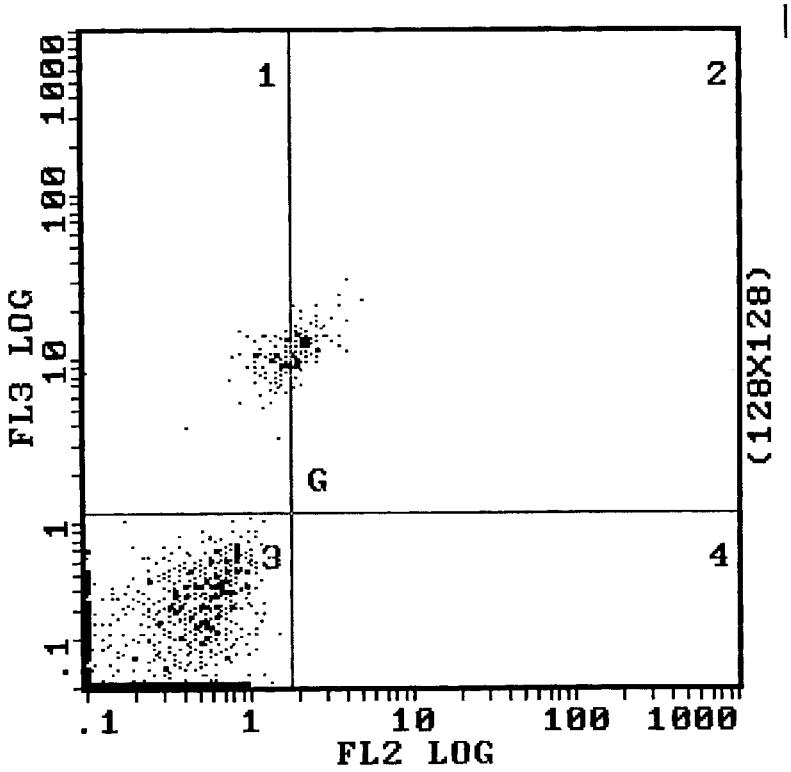
Figure 2D:
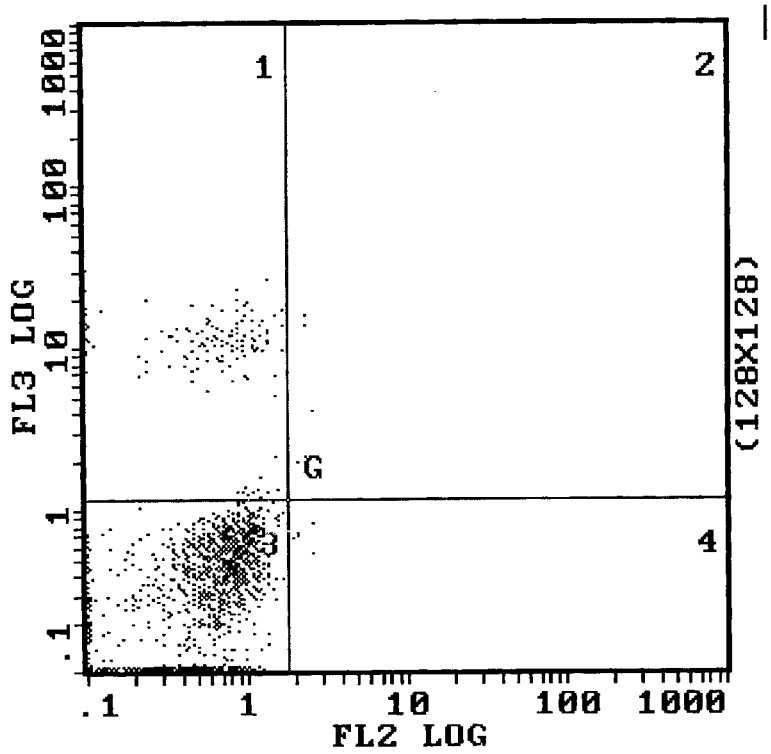

More specifically,

FIGS. 1A and 2A relate to a conjugate protected from the light, serving as a control, FIGS. 1B and 2B relate to a conjugate packaged in a commercially available Beckman Coulter Immunotech glass bottle from the IOTEST range, FIGS. 1C and 2C relate to a conjugate packaged in a commercially available Beckman Coulter Immunotech glass bottle from the Cytostat range, FIG. 1D relates to a conjugate packaged in a commercially available BECTON DICKINSON Pharmingen glass bottle, and FIGS. 1E and 2D relate to a conjugate packaged in a commercially available Beckman Coulter Immunotech glass bottle from the IOTEST range covered with a layer of epoxy varnish following the electrostatic powdering process of Example 1.

DETAILED DESCRIPTION OF THE INVENTION

EXAMPLE 1

Coating a Glass Bottle using Epoxy Resin

Commercially available Beckman Coulter Immunotech glass bottles from the IOTEST range intended to receive anti-CD3-phycoerythrin-cyanine 5 antibody conjugates are placed on a production line using the following stages:

The bottles are washed.

They are passed through a drying oven.

They are then passed through a chamber in which the bottles are covered with a septum pierced by an electrode.

Matte black AKZO epoxy resin powder reference NOIR MAT 1P200 8391 (new reference AN052F) with a charge opposite to that of the pulverized electrode in the chamber is applied by electrostatic phenomena on the surface of the bottles that are then passed through a baking oven at 180° C.

EXAMPLE 2

Coating a Glass Bottle Using a Heat-shrinkable Polyethylene Sleeve

The sides and the neck of commercially available 6 ml Beckman Coulter Immunotech glass bottles from the IOTEST range intended to receive anti-CD3-phycoerythrin-cyanine 5 antibody conjugates using a heat-shrinkable polyethylene sleeve marketed by the SLEEVER INTERNATIONAL company.

EXAMPLE 3

Manufacture of a Glass Bottle Covered with Epoxy Resin Filled with a Solution of Anti-CD3-phycoerythrin-cyanine 5 Antibody Conjugates in PBS, 2 mg/ml BSA, 0.1% Sodium Azide.

Bottles manufactured according to Example 1 are each filled with 2 ml of a solution of anti-CD3-phycoerythrin-cyanine 5 antibody conjugates in phosphate/bovine serum albumin (2 mg/ml)/0.1% sodium nitride buffer.

EXAMPLE 4

Test of the Storage of Anti-CD3-phycoerythrin-cyanine 5 Antibody Conjugates In order to demonstrate the effectiveness of the process of the invention, commercially available and modified bottles containing anti-CD3 antibodies conjugated to PC5 and ECD fluorochromes were subjected to a forced degradation test according to the method described in the Good Manufacturing Practice (GMP) of the American Food and Drug Administration.

Different packaging was tested:

Commercially available Beckman Coulter Immunotech bottle from the IOTEST range

Commercially available Beckman Coulter Immunotech bottle from the Cytostat range Commercially available Beckman Coulter Immunotech bottle from the IOTEST range covered with a layer of epoxy varnish according to the electrostatic powdering process Commercially-available BECTON DICKINSON Pharmingen bottle.

These bottles containing the antibody-tandem conjugates were introduced into a chamber provided with fluorescent tubes and were subjected to a total light dose of $1.2.10^6$ lux.h.

FIG. 1 shows the excellent protection given to the contents of the bottles by implementing the invention. In fact the tandems introduced into the Beckman Coulter Immunotech bottle from the IOTEST range covered with a layer of epoxy varnish according to the electrostatic powdering process presents an autofluorescence in FL2 identical to that of the non-irradiated control. On the other hand all the other types of bottle show a permeability to light which is translated by a <<loss>> of FL2, that is to say an increase in autofluorescence with an appearance of false positive cells.

EXAMPLE 5

Test of the Storage of Anti-CD19-phycoerythrin-texas Red Antibody Conjugates The process is carried out in the same way as in Example 4, but with anti-CD19-phycoerythrin-texas red antibody conjugates. The results are given in FIG. 2.

Analysis of the results leads to the same conclusions as in Example 4.

What is claimed is:

1. Packaging comprising a fluorochrome sensitive to visible light and a bottle in which the said fluorochrome is placed, at least the side walls of the said bottle are screened against light spectrum radiation between 200 and 900 nm wherein the side walls of the bottle have a structure which blocks at least 95% of visible light radiation, and wherein the fluorochrome is selected from the group consisting of fluorescein isothiocyanate (FITC), phycoerythrin (PE), allophycocyanine (APC), PercP, or is part of a phycoerythrin-cyanine 7 (PC7), phycoerythrin-texas red (ECD or PETR) tandem.

2. Packaging according to claim 1, wherein the bottom of the bottle also forms an effective screen against visible spectrum radiation.

3. Packaging according to claim 1 or 2, wherein the screening effect effective against radiation is obtained by coating with electrostatic powdering, by covering the bottle with a sleeve, by irradiating some types of glass with gamma radiation, or by cast moulding.

4. Packaging according to claim 2, wherein the fluorochrome is selected from the group consisting of fluorescein isothiocyanate (FITC), phycoerythrin (PE), allophycocyanine (APC), PercP, or is part of the phycoerythrin-cyanine 7 (PC7), phycoerythrin-cyanine 5 (PC5) and phycoerythrin-texas red (ECD or PETR) tandems.

5. Process for protecting fluorochromes sensitive to visible light during storage, in which said fluorochromes are placed in a bottle of which at least the side walls are screened against light spectrum radiation between 200 and 900 nm wherein the side walls of the bottle have a structure which blocks at least 95% of visible light radiation, and wherein the fluorochrome is selected from the group consisting of fluorescein isothiocyanate (FITC), phycoerythrin (PE), allophycocyanine (APC), PercP, or is part of a phycoerythrin-cyanine 7 (PC7), phycoerythrin-texas red (ECD or PETR) tandem.

* * * * *